United States Patent [19]

Furuhashi et al.

[11] 4,359,029

[45] Nov. 16, 1982

[54] AIR/FUEL RATIO CONTROL SYSTEM FOR AN INTERNAL COMBUSTION ENGINE

[75] Inventors: Shoji Furuhashi, Yokohama; Masaharu Asano, Yokosuka; Hideyuki Tamura, Yokohama, all of Japan

[73] Assignee: Nissan Motor Company, Limited, Yokohama, Japan

[21] Appl. No.: 153,914

[22] Filed: May 28, 1980

[30] Foreign Application Priority Data

May 31, 1979 [JP] Japan ..... 54-67710

[51] Int. Cl.[3] ..... F02B 3/00

[52] U.S. Cl. ..... 123/440; 123/489

[58] Field of Search ..... 123/440, 489

[56] References Cited

U.S. PATENT DOCUMENTS 4,170,965 10/1979 Aono ..... 123/440

4,244,340 1/1981 Herth ..... 123/440

4,266,519 5/1981 Nurimatsu ..... 123/440

*Primary Examiner*—Donald B. Cox

*Attorney, Agent, or Firm*—Schwartz, Jeffery, Schwaab, Mack, Blumenthal & Koch

[57] ABSTRACT

Disclosed is an air/fuel control system for an internal combustion engine which selectively carries out open loop control and feedback control in which the air/fuel ratio is controlled based on the sensed concentration of an exhaust gas component. The system has a means for generating a variable reference signal corresponding to an exhaust gas sensor output and a means for measuring a period after the air-fuel mixture becomes rich and for generating a signal for switching control operation from feedback control to open loop control. The latter means clears the measured period responsive to interrupting feedback control after the expiration of a given period. This effectively prevents control operation from switching too frequently between feedback control and open loop control.

18 Claims, 10 Drawing Figures

AIR/FUEL RATIO CONTROL SYSTEM FOR AN INTERNAL COMBUSTION ENGINE

BACKGROUND OF THE INVENTION

1. Field of the Invention

The present invention relates generally to an air/fuel ratio control system for an internal combustion engine. More particularly, the invention relates to feedback air/fuel ratio control system utilizing an exhaust gas sensor. More particularly still, the present invention relates to switching between feedback control and open loop control for selectively carrying out either one depending upon the engine driving condition.

2. Description of the Prior Art

Recently, there have been developed various air/fuel ratio control systems for decreasing harmful exhaust gas components such as CO, HC, $NO_x$ and so on which may be generated in of an internal combustion engine. The prior art air/fuel ratio control systems, typically control the air/fuel ratio in accordance with the concentration of an exhaust gas component. In such system, a control output is determined according to the sensed exhaust gas component concentration which is used for feedback controlling a fuel supply means such as fuel injector, carburetor or the like.

Generally, such air/fuel ratio control system includes a circuit for determining the difference between the exhaust gas sensor output and reference input which is predetermined corresponding to a target air/fuel ratio of the air-fuel mixture, and a control circuit for generating a control output corresponding to determined difference. By setting the reference input of the difference determining circuit to corresponding to a target air/fuel ratio having a corresponding exhaust gas component concentration which will make the most effectively use an exhaust gas purifier, and by controlling the actual air/fuel ratio to approach to the target ratio, the harmful component in the exhaust gas can be effectively eliminated. For example, where a so-called three-way catalyst is employed as the exhaust gas purifier, the target air/fuel ratio will be approximately the same as a stoichiometric ratio. In such a system, an exhaust gas sensor such as a zirconia oxygen sensor is provided in an exhaust gas passage connecting the combustion chamber to the exhaust gas purifier for measuring an exhaust gas component concentration. Since the output voltage of the exhaust gas sensor varied depending upon its internal resistance, it becomes difficult to accurately measure the exhaust gas component concentration using the exhaust gas sensor in a relatively low temperature condition. Consequently, in the temperature range in which the exhaust gas sensor can not accurately and successfully work, air/fuel control operation should be switched from feedback control to open loop control.

For determining whether the sensor temperature is sufficiently high to accurately determine the exhaust gas component concentration, a given electric current is supplied to the exhaust gas sensor and output voltage of the sensor is measured. A minimum voltage and maximum voltage for defining a range in which the exhaust gas sensor will accurately work, is compared with the sensor output voltage. One means for supplying electric current to the exhaust gas sensor is disclosed in co-pending U.S. patent application Ser. No. 145,987 filed with U.S. Patent and Trademark Office on May 2, 1980 corresponding to Japanese Patent Application No. 54-54061, filed May 4, 1979 by Masaharu ASANO et al.

It is also desirable to vary the reference input of the difference determining circuit according to the output voltage of the exhaust sensor for effectively correcting the sensor output when the sensor temperature is too low to accurately determining an exhaust gas component concentration.

For varying the reference input to the difference determining circuit, a reference input generator is provided with the air/fuel ratio control system. The reference input generator generates a reference signal which is varied according to parameters such as the exhaust gas sensor output voltage which is inputted thereto. On the basis of the reference input and the exhaust gas component concentration, the difference determining circuit determines the difference therebetween. When the sensor output is larger than the reference input, a rich monitoring circuit generates an output signal. In response to output signal fed from the rich monitoring circuit, a switching circuit operates to switch control operation from feedback control to open loop control.

In applicants' system, when the control operation is switched from feedback control to open loop control, the value in the rich monitoring circuit is cleared and the rich monitoring circuit becomes inoperative thereby preventing control operation from frequently being switched between the feedback control and open loop control. However, if the engine is maintaned in an idle condition for a relatively long period, the exhaust gas sensor temperature is lowered thereby increasing its internal impedance. Therefore, the sensor output is increased relative to the exhaust gas component concentration. Therefore, the output of the difference determining circuit will indicate a rich mixture condition even if the air-fuel mixture is actually in a lean condition. As a result, soon after switching the control operation from open loop control to feedback control, feedback control will again be interrupted and open loop control resumed.

If the engine is driven at relatively low engine speeds, it becomes necessary to increase the fuel supply to make the air-fuel mixture richer for eliminating the possibility of engine stall. Such a correcting operation is carried out by open loop control in response to a sensed decreasing of the engine speed lower a given speed. If, by increasing the fuel supply, the engine speed exceeds the given speed, control operation returns to feedback control. However, at this point, the air/fuel ratio of the air-fuel mixture will be normally rich, thereby control operation will again be switched to open loop control. This switching will be cyclically repeated to cause unstable driving of the engine.

SUMMARY OF THE INVENTION

Therefore, it is an object of the present invention to provide an air/fuel ratio control system which can prevent control operation from too frequently switching between feedback control and open loop control.

Another object of the present invention is to provide an air/fuel ratio control system in which either feedback control or open loop control is selectively carried out, and in feedback control the control ratio is determined corresponding to an exhaust gas component concentration and a reference value which is determined corresponding to desired air/fuel ratio and is varied corresponding to the exhaust gas sensor output.

A further object of the present invention to provide an air/fuel ratio control system having a means for supplying an electric curent to the exhaust gas sensor, which the means varies the current value corresponding to control condition.

To achieve the above-mentioned and other objects, an air/fuel ratio control system in accordance with the present invention has a means for generating a variable reference signal in accordance with an exhaust gas sensor output and a means for measuring a period after an air-fuel mixture becomes rich and generating a signal for switching control operation from feedback control to open loop control. The latter means then clears the measured period, responsive to an interrupting feedback control signal after the expiration of a given period thereby preventing control operation from too frequently switching between feedback control and open loop control.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The present invention will become more fully understood from detailed description given below, and from the accompanying descriptions of embodiments of the present invention, which however, are not to be taken as limitative of the present invention in any way, but are for the purpose of elucidation and explanation only.

In the drawings.

DESCRIPTION OF THE PREFERRED EMBODIMENT

Figure 1:
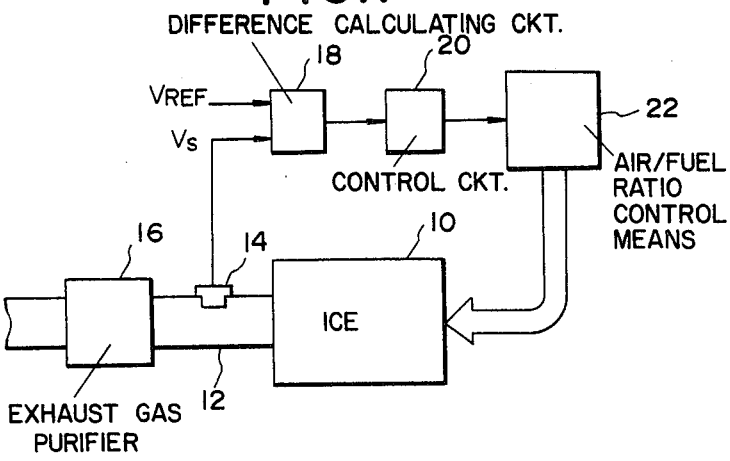
FIG. 1 is a schematic block diagram of a typical air/fuel ratio control system, using an exhaust gas sensor signal as one of the control parameter for feedback control.

Referring now to the drawings, particularly to FIG. 1, there is illustrated a typical air/fuel ratio control system for an internal combustion engine. In such air/fuel ratio control systems, the air/fuel ratio of the air-fuel mixture delivered to the internal combustion engine 10 is controlled selectively either by feedback control or by open loop control. During feedback control, the exhaust gas from the internal combustion engine and flows through an exhaust passage 12 and the concentration of component thereof is measured by exhaust gas sensor 14 which is provided upstream of exhaust gas purifier 16 in the exhaust passage 12. A sensor signal Vs from the exhaust gas sensor 14, indicative of the measured concentration of the exhaust gas component, is generated by the exhaust gas sensor 14. The sensor signal Vs is inputted to a circuit 18 for calculating the difference between the sensor signal Vs and a reference signal $V_{REF}$ which is determined corresponding to target air/fuel ratio and which is also inputted to the difference calculating circuit 18. Generally, as the difference calculating circuit, a differential amplifier or comparator will be employed. A control circuit 20 is used with the difference calculating circuit 18. Based upon the output of the difference calculating circuit 18, the control circuit 20 generates a control signal which is proportional either to the determined difference signal or to an integral signal obtained by integrating the difference signal, or to the sum of both the difference signal and the integral signal. The control signal is then fed to an air/fuel ratio control means 22 such as a carburetor, fuel injector or the like in order to control the amount of fuel and the air flow rate and thereby to control air/fuel ratio of the air-fuel mixture delivered to the internal combustion engine. In that manner, the actual air/fuel ratio will approach the desired or target ratio.

If the desired air/fuel ratio is determined to be a value at which the exhaust gas purifier 16 (which may include such devices as a catalyst or reactor) is effectively operated, the harmful component in the exhaust gas can be effectively and successfully reduced. When a so called three-way catalyst device which can oxide CO and HC and reduce $NO_x$ is used as the exhaust gas purifier 16, the desired air/fuel ratio is substantially the same as stoichimetric ratio.

Figure 2:
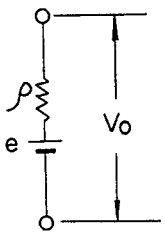
FIG. 2 is a circuit diagram of an equivalent circuit of a zirconia oxygen sensor used as the exhaust gas sensor in the air/fuel ratio control system of FIG. 1.
Figure 3:
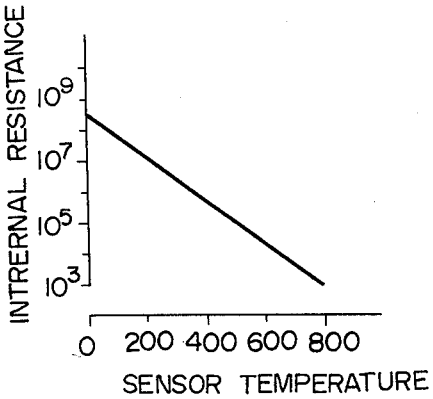
FIG. 3A is a graph showing the relationship between the internal resistance and the temperature of zirconia oxygen sensor.
FIG. 3B is a graph showing variation of voltage output of the zirconia oxygen sensor of FIG. 2 corresponding to the air/fuel ratio.
Figure 3:
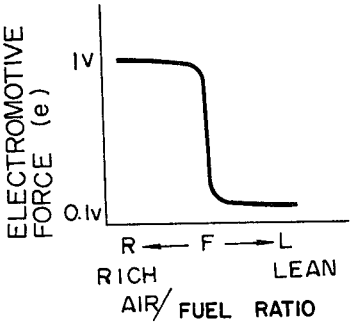

FIG. 2 shows an equivalent electrical circuit of the zirconia oxygen sensor 12, which includes a battery producing a variable voltage e corresponding to the oxygen concentration, and an internal resistance value $\rho$ varying according to the sensor temperature. As shown in FIG. 3, the resistance value $\rho$ is substantially inversely proportional to the logarithm of the sensor temperature. When the sensor temperature is in the normal range, the voltage e of the battery varies as shown in FIG. 3B. When the air-fuel mixture is rich, the voltage e is about 1 V, and when the mixture is lean, the voltage e is about 0.1 V. However, if the sensor temperature is low, the internal resistance $\rho$ is extremely high, and the sensor cannot deliver sufficient current to drive the control circuit reliably.

Therefore, in the air/fuel ratio control device, there is provided a means for sensing the sensor temperature. The sensor temperature sensing means determines whether the sensor temperature permits carrying out feedback control. In a typical method for determining the sensor temperature, a steady electric current i is supplied to the sensor 12 from an external power supply means. When the steady electric current is supplied, the output voltage $V_0$ of the sensor 12 is calculated by the following equation;

$$V_0 = e + \rho i$$

From this equation, the output voltage $V_0$ is linearly dependent on the value $\rho$ of the internal resistance. If the sensor temperature is increased to reduce the resistance value $\rho$, the output voltage $V_0$ is reduced accordingly. Thus, by detecting whether the output voltage $V_0$ is within or outside of a normal range (which is defined between given minimum and maximum voltages), the temperature sensor determines whether carrying out feedback control is permitted.

For supplying electric current to the exhaust gas sensor for determining the sensor temperature conditioner, the co-pending U.S. patent application Ser. No. 145,987 filed on May 2, 1980, as conventional application based on Japanese Patent Application No. 54-54061, discusses the preferred form of the current supplying circuit. In the aforesaid U.S. patent application, there is disclosed an air/fuel ratio control device capable of carrying out feedback control in which a control signal indicating the concentration of exhaust gas components is generated and fed to an air/fuel ratio control means in which a fuel supply rate is determined corresponding to an intake air flow rate. For switching between feedback control and open loop control, the air/fuel ratio control system is provided with a means for detecting an abnormal condition of an exhaust gas sensor and for thereupon generating an abnormal signal, and a means operative in response to the abnormal signal to interrupt feedback control. The air/fuel ratio control device is further provided with a means for detecting the stopping of the abnormal condition and for thereupon returning control operation to feedback control.

According to the invention described in the aforesaid U.S. patent application, a reference value to be compared with the exhaust gas sensor output in order to determine whether the air-fuel mixture is rich or lean, is set to a minimum value when the abnormal signal is detected. Thus, when the control operation returns to feedback control, since the reference value is at a minimum, switching from open loop control to feedback control is performed smoothly. In the preferred embodiment shown in Ser. No. 145,987, after returning to feedback control, the reference value is gradually increased at a given rate and a given timing so that the control can be adapted smoothly to the engine condition.

Figure 4:
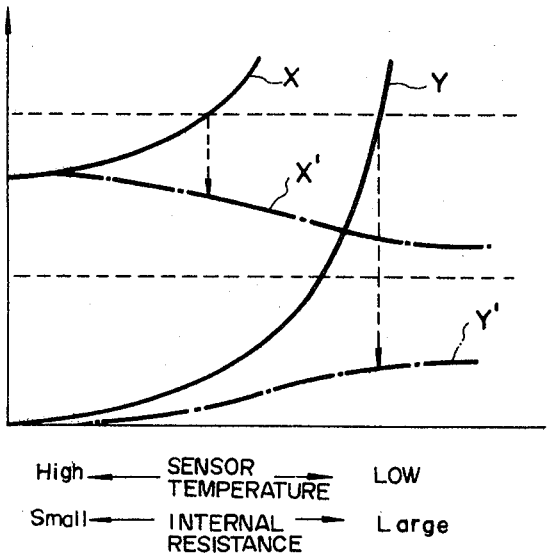
FIG. 4 is a graph showing temperature characteristics of the output voltage of the circuit of FIG. 2, illustrating the variation of the electric voltage when the power supply is on and the air-fuel mixture is rich when the power supply is off and the air-fuel mixture is rich (X'), when the power supply is on and the air-fuel mixture is lean (Y), and when the power supply is off and the air-fuel mixture is lean (Y')

FIG. 4 shows a relationship between the exhaust gas sensor temperature, internal resistance and the sensor output. In FIG. 4, the curve X represents a variation of sensor output corresponding to varying of the sensor temperature and internal resistance when the air-fuel mixture is rich. The curve X' represents a variation of the sensor output when the supplying the electric current is interrupted and the air-fuel mixture is rich. Likewise, the curve Y represents a variation of the sensor output when electric current is supplied and the air/fuel ratio is lean and curve Y' represents the same when the supplying electric current is interrupted.

Figure 5:
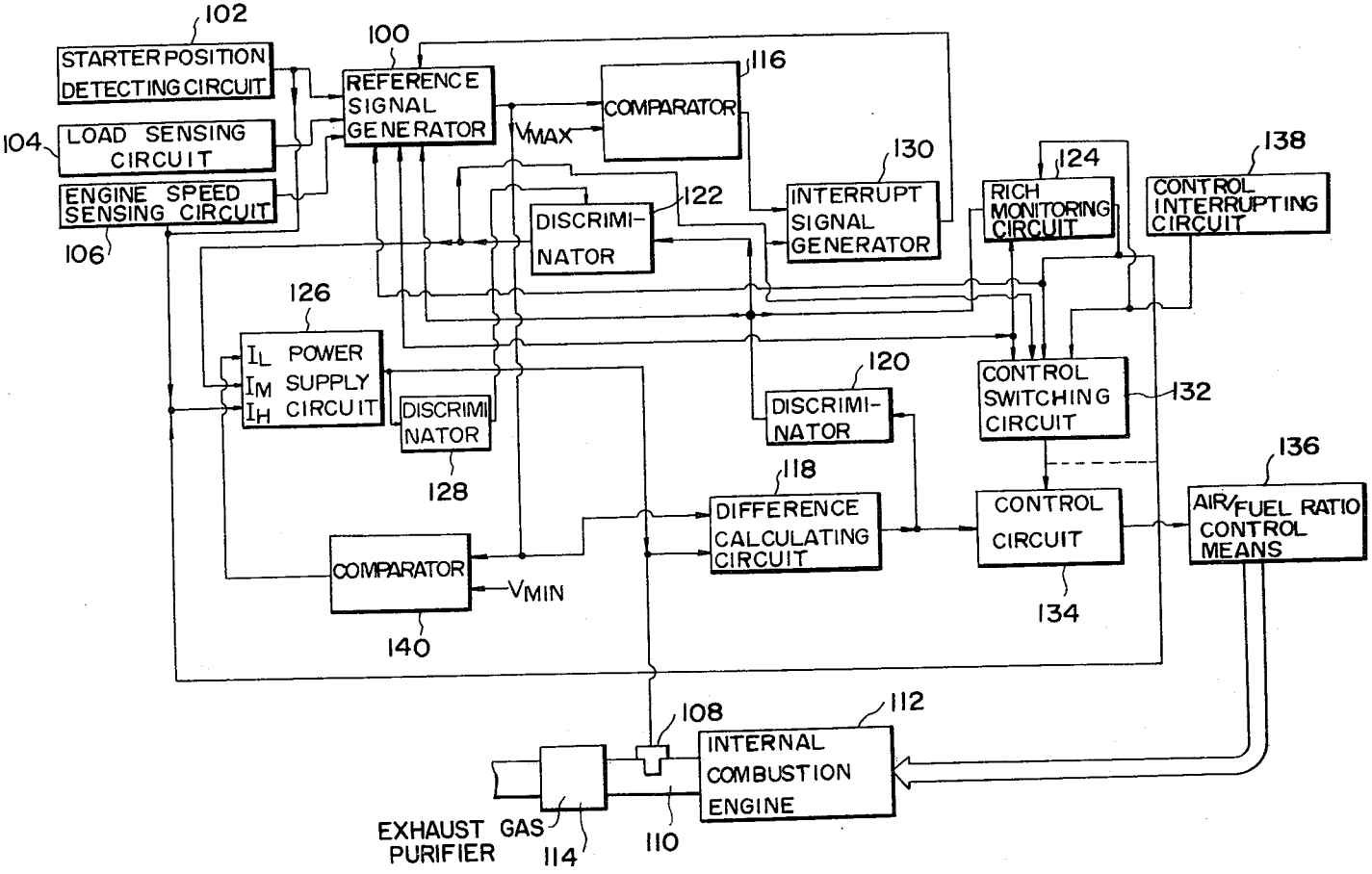
FIG. 5 is a block diagram of the air/fuel ratio control system FIG. 1, in which the system is modified according to the present invention.

For correcting the sensor output in response to lowering of sensor temperature and degrading sensor quality, it is desirable to vary the reference signal $V_{REF}$ corresponding to sensor output. FIG. 5 shows one of the typical construction of air/fuel ratio control system for feedback control air/fuel ratio by the reference signal $V_{REF}$ which is varied corresponding to the sensor output.

A reference signal generator 100 is incorporated with a starter position detecting circuit 102, a load sensing circuit 104 and an engine speed sensor 106. The starter position detecting circuit 102 is operative in response to turning the starter on or cranking of the engine and generates a signal indicative of engine starting (hereafter referred as "starter signal"). The load sensing circuit 104 determines the load such as, for example, a basic fuel injection time (hereafter referred as "Tp time") determined corresponding to air flow rate and engine speed and other control parameters in an electronic controlled fuel injection system. The load sensing circuit 104 generates a signal indicative of the load condition (hereafter referred as "load signal"). The engine speed sensor 106 such as crank angle sensor circuit determines an engine speed and generates a signal indicative of determined engine speed (hereafter referred as "engine speed signal"). An exhaust gas sensor 108 is provided in an exhaust passage 110 connecting between an internal combustion engine 112 and an exhaust gas purifier 114 and outputs an exhaust gas sensor output Vs indicative of exhaust gas concentration determined thereby (hereafter referred as "exhaust gas signal"). The starter signal, load signal and the engine speed signal are inputted to the reference signal generator 100.

The reference signal generator 100 determines and generates a reference signal $V_{REF}$ corresponding to the exhaust gas signal Vs, starter signal, load signal, engine speed signal and so on. The reference signal $V_{REF}$ is fed to a comparator 116. To the comparator 116 is inputted a signal indicative of a maximum value $V_{MAX}$ for carrying out feedback control. If the value of reference signal $V_{REF}$ exceeds the maximum value $V_{MAX}$, the comparator 116 generates and outputs a signal. The reference signal $V_{REF}$ is also inputted to a difference calculating circuit 118 to which also the exhaust gas signal Vs is inputted. Based on the reference signal $V_{REF}$ and the exhaust gas signal Vs, the difference calculating circuit 118 determines a difference therebetween and outputs a signal indicative of determined difference (hereafter referred as "difference signal"). The difference signal is fed to a discriminator 120 for discriminating whether the air-fuel mixture charged to the internal combustion engine 112 is rich or lean. The discriminator 120 outputs either a signal indicative of the air-fuel mixture being rich (hereafter referred as "rich signal") if it determines air-fuel mixture is rich based on the difference signal, or a signal indicative of air-fuel mixture being lean (hereafter referred as "lean signal").

It should be noted that the discriminator 120 is not always necessary. If the discriminator 120 is omitted from the system, the difference signal generated in the difference calculating circuit 118 is used for discriminating whether the air-fuel mixture is rich or lean.

The rich or lean signal is fed to a discriminator 122 for descriminating the condition of the exhaust gas sensor and whether the air-fuel mixture is rich or lean. The discriminator 122 outputs a signal (hereafter referred as "feedback signal") for carrying out feedback control when the exhaust gas sensor temperature is adapted to carry out feedback control and the signal fed from the discriminator 120 is lean signal. The rich or lean signal is also inputted to a rich monitoring circuit 124. In response to a rich signal, the rich monitoring circuit 124 outputs a signal for carrying out open loop control (hereafter referred as "open loop signal").

For determining whether temperature condition of the exhaust gas sensor 108 is adapted for carrying out feedback control, there is provided a power supply circuit 126 for supplying an electric current to the exhaust gas sensor. The power supply circuit 126 varies the current value corresponding to controlling condition. The manner for operating and circuit construction of this power supply circuit 126 is discussed in co-pending U.S. patent application Ser. No. 145,987.

A discriminator 128 is incorporated with the power supply circuit 126 and generates a signal when it discriminates the current supplied to the exhaust gas sensor 108 exceeding a given value.

The outputs of the comparator 116 and the feedback signal fed to a interrupt signal generator 130. In response to an output of either one of the comparator or feedback signal, the interrupt signal generates an interrupt signal to be fed to the reference signal generator 100. Responsive to the interrupt signal, the reference signal generator 100 is interrupted to increase the reference signal value.

The feedback signal generated in the discriminator 122 and the open loop signal generated in the rich monitoring circuit 124 are fed to a control switching circuit 132. The control switching circuit 132 determines whether feedback control or open loop control is to be carried out and is responsive to feedback signal and the open loop signal and generates a switching signal. Responsive to the switching signal, a control circuit 134 switches control operation between feedback control and open loop control. In the feedback control the control circuit 134 determines a control ratio to control an air/fuel ratio control means 136 such as carburetor, fuel injector or the like based on the difference signal fed from the difference calculating circuit. On the other hand, in the open loop control, the control circuit determines a control ratio so that maintain the air/fuel ratio constant.

A control interrupting circuit 138 is incorporated with the control switching circuit 132 for interrupting feedback control. The control interrupting circuit 138 generates a interrupt signal when temperature of an engine coolant such as cooling water is lower than a given temperature or fuel supply system is in a fuel shut off position. Further, if the air/fuel ratio is controlled corresponding to engine speed and/or load condition, the control interrupting circuit 138 also outputs the interrupt signal. In response to the interrupt signal, the control switching circuit generates the switching signal to carry out open loop control in the control circuit.

The reference signal $V_{REF}$ generated by the reference signal generator 100 is fed to a comparator 140 which compares the reference signal $V_{REF}$ with a reference minimum value $V_{MIN}$ which defines a lower limit of the reference signal $V_{REF}$. The comparator 140 generates a signal when the reference signal $V_{REF}$ is less than the minimum value $V_{MIN}$. The comparator 140 is incorporated with the power supply circuit 126 and inputs thereto the signal to vary the electric current supplied to the exhaust gas sensor.

Hereafter, the functions of the reference signal generator 100 and the power supply circuit 126 will be described in more detail together with slightly more details of functions of other elements.

After starter switch is turned off and no starter signal is outputted from starter position detecting circuit, the reference signal generator 100 generates a minimum reference signal $V_{REF}$, e.g. on the order of 420–430 mV, for a given period. The period is defined by engine revolution and the reference signal $V_{REF}$ is maintained at the minimum voltage, within 30 to 60 cycles of engine revolution, for example. After expiration of the given period, the reference signal generator 100 increases the value of reference signal $V_{REF}$ at a given rate, for example on the order of 30–40 mV per one cycle of engine revolution. When voltage of the reference signal $V_{REF}$ becomes equal to or more than about 1.2 V and thereby the comparator 116 outputs a signal so as to operate the interrupt signal generator 130, or when the air-fuel mixture becomes rich and thereby the discriminator 122 interrupts to output feedback signal, the reference signal generator 100 stops increasing the value of the reference signal $V_{REF}$. Furthermore, if the load signal, rich or lean signal and the signal of the discriminator 122 are inputted, the reference signal generator 100 generates a reference signal which is determined by multiplication of the previous reference signal and a given constant, for example on the 0.6 to 0.8. Thereafter, the determined reference signal $V_{REF}$ is decreased at a given rate, e.g. on the order of 10 mV per a given timing. The timing for decreasing the reference is defined by the cumulatively increased Tp time. For example, when the cumulatively increased Tp time becomes about 15 to 20 ms, the reference signal $V_{REF}$ is decreased by about 10 mV when operating under conditions of a lean air-fuel mixture. Responsive a rich air-fuel mixture the reference signal $V_{REF}$ is decreased by about 50 mV for example.

If the reference signal $V_{REF}$ is decreased until the given minimum value, e.g. on the order of 420 to 430 mV, responsive to a rich air-fuel mixture the minimum reference signal is outputted. Responsive to a lean air-fuel mixture, the minimum reference signal $V_{REF}$ is increased by about 50 mV.

On the other hand, responsive to an open loop signal fed from the rich monitoring circuit 124, open loop control is carried out. In open loop control, the reference signal $V_{REF}$ is increased by a given rate and a given timing after expiration of a period, for example of 10 to 20 cycles of engine revolution, after switching control operation from feedback control to open loop control. For example, the reference signal $V_{REF}$ is increased by on the order of 30 to 50 mV per cycle of engine revolution. When the reference signal $V_{REF}$ becomes equal to or more than the exhaust gas signal Vs or maximum value $V_{MAX}$, the reference signal generator 100 operates the same as discussed above for feedback control. If the condition of the air-fuel mixture and the exhaust gas temperature condition become adapted to carrying out feedback control while the control system is carrying out open loop control, control operation can be switched from open loop control to feedback control. Since carrying out open loop control for a long time results in less efficient exhaust gas purification, it is advantageous to carry out feedback control if the conditions are adapted therefor.

Regarding the power supply circuit 126, the starter signal, open loop signal, feedback signal and the signal of the comparator 140 are inputted. When the starter signal or open loop signal is inputted, the power supply circuit 126 outputs the highest current $I_H$. If the feedback signal is inputted, the power supply circuit 126 outputs the intermediate value of current $I_M$. If the signal fed from the comparator 140 is detected, the current $I_L$ supplied to the exhaust gas sensor becomes the lowest.

It will be possible to switch the value of current by inputting the switching signal generated and outputted from the control switching circuit. Further, if necessary, the power supply circuit 126 outputs the highest current $I_H$ in response to turning ignition switch on.

Upon engine starting or during open loop control, the current supplied to the exhaust gas sensor 108 is the highest $I_H$. When carrying out open loop control and when the reference signal $V_{REF}$ becomes larger than the exhaust gas signal, Vs, for the first time, (in other words when control operation is switched from open loop control to feedback control), the supplied current from the power supply circuit 126 is at its intermediate value $I_M$. If the reference signal $V_{REF}$ becomes less than the given minimum value $V_{MIN}$, the power supply circuit 126 outputs the lowest current $I_L$.

Figure 6:
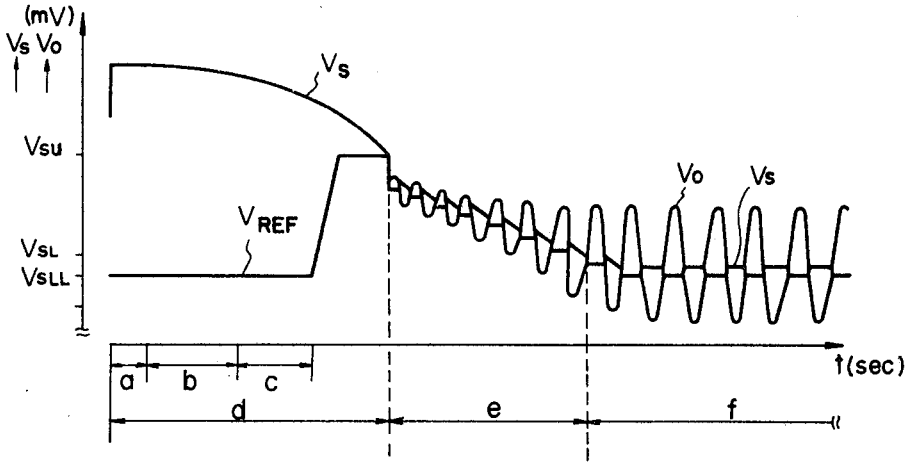
FIG. 6 is a graph showing the variation of the reference signal and the exhaust gas sensor signal when the engine is started under cold engine condition.
Figure 7:
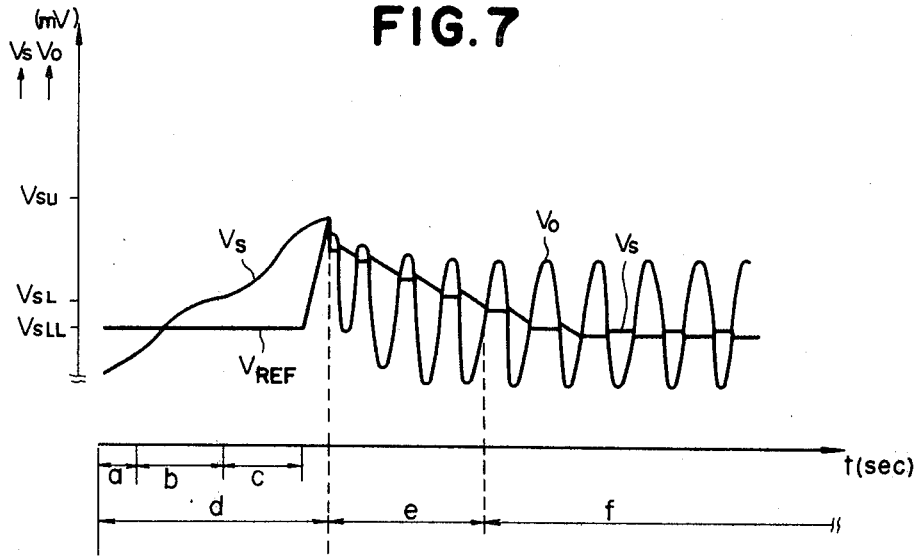
FIG. 7 is a graph showing the variation of the reference signal and the exhaust gas sensor signal when the engine is started after being sufficiently warmed up.

Referring to FIGS. 6 and 7, there is illustrated the relationship between the exhaust gas signal Vs and the reference signal $V_{REF}$ under cold starting condition and engine warmed up condition respectively. In FIGS. 6 and 7, $V_{SLL}$ represents the minimum value of the reference signal $V_{REF}$. During the time period represented as a in which the ignition switch is turned on, the reference signal $V_{REF}$ is maintained the minimum value $V_{SLL}$. Also, during the time periods the starter switch is turned on and within initial starting of the engine, e.g. 30–60 cycles of engine revolution, respectively represented by b and c, the reference signal $V_{REF}$ is maintained at the minimum value $V_{SLL}$.

The time period represented by d indicates the period during which the highest current $I_H$ is supplied to the exhaust gas sensor 108. Time periods e and f respectively indicate periods in which the intermediate and lowest current $I_M$ and $I_L$ are supplied to the exhaust gas sensor 108. In FIG. 7, the exhaust gas signal Vs is initially a relatively lower value than $V_{REF}$, since by warming up of the engine, the exhaust gas sensor 108 is warmed up and thereby the internal impedance is relatively low.

Turning now to the rich monitoring circuit 124 and the control interrupting circuit 138, there is now provided a more detailed explanation regarding the functions thereof and the relationship therebetween. For interrupting feedback control, the engine coolant temperature, load condition such as Tp time engine speed, fuel shut off condition and condition of the exhaust gas sensor act as interrupt factors. Corresponding to these factors, the current value supplied from the power supply circuit 126 is varied. If the feedback control is interrupted corresponding to a dropping of the engine temperature, the supplied current is the highest value $I_H$ which acts to gradually increase the reference signal $V_{REF}$ to check the exhaust gas sensor condition. On the other hand, if the feedback control is interrupted corresponding to the load condition and/or engine speed, the supplied current is not varied and thereby, the reference signal $V_{REF}$ is gradually decreased. However, in either case, when the feedback control is interrupted, the signals inputted to the rich monitoring circuit 124 are cleared. Therefore, the rich monitoring circuit 124 is inoperative when feedback control is interrupted. If the rich monitoring circuit 124 were operative even when feedback control was interrupted, inasmuch as the actual air/fuel ratio would be considerably different from the stoichimetric ratio, the rich monitoring circuit would operate to stop control operation of the air/fuel ratio control system. Thus, by rendering the rich monitoring circuit 124 inoperative during the feedback control interrupted condition, unnecessary stopping of the control operation can be prevented.

Figure 8:
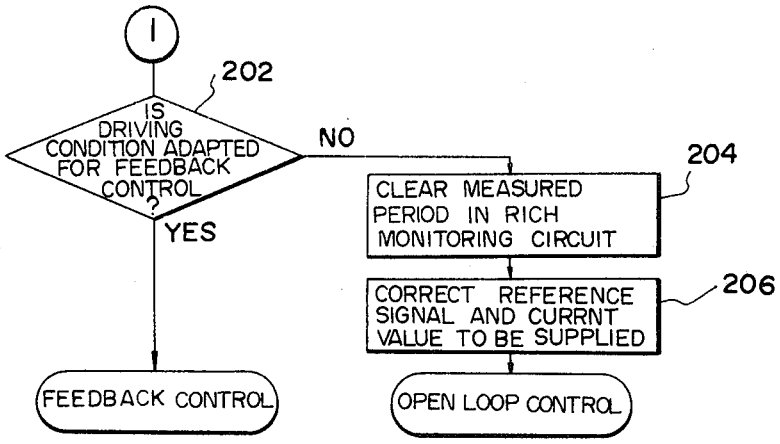
FIG. 8 is a flowchart of a control operation of the air/fuel ratio control system of FIG. 5, showing the general concept of the control operation.

Now referring to FIG. 8, there is shown a flowchart of control operation carried out by the above mentioned air/fuel ratio control system. When carrying out feedback control, the temperature condition of the exhaust gas sensor 108, the load condition, and the engine speed are checked at a decision block 202 to determine whether feedback control can be carried out. If the decision of the block 202 is YES, then feedback control is maintained and carried out. If the decision of the block 202 is NO, signals inputted to the rich monitoring circuit 124 are cleared at block 204. Thereafter, the reference signal $V_{REF}$ outputted from the reference signal generator and the current supplied to the exhaust gas sensor 108 from the power supply circuit 126 are varied to carry out open loop control at a block 206. Then, open loop control is carried out.

In the above-mentioned control operation, if the engine is maintained in idling position for relatively long time, the internal impedance of the exhaust gas sensor 108 rises corresponding to drop of the sensor temperature to cause malfunction in the control. Namely, when the sensor impedance are risen, the exhaust gas signal Vs outputted from the exhaust gas sensor 108 is increased.

As the result, the exhaust gas signal Vs exceeds the reference signal $V_{REF}$ without corresponding to rich or lean condition in the air-fuel mixture.

In addition, in the air/fuel ratio control system, when the engine is driven at relatively low speed, for example equal to or less than about 600 r.p.m. in the engine idling position, the fuel amount is increased to make the air/fuel ratio rich in order to prevent the engine from stalling. For increasing the amount of fuel supplied by injection or otherwise when the engine speed is relatively low, open loop control is carried out. For example, when the fuel amount is increased and thereby the exhaust sensor signal Vs is increased by an amount which exceeds the reference signal $V_{REF}$, since feedback control is maintained and carried out for a given period of time, for example 6–7 sec., the fuel amount will be decreased to make the air-fuel mixture leaner by feedback control. This may cause decreasing engine speed to engine stall.

If the engine speed decreases to a predetermined speed whereby the control system generates an increment correction of the fuel amount within the above-mentioned period to maintain feedback control, feedback control will be interrupted and increment correction for the fuel amount is generated. At this time, the signals inputted to the rich monitoring circuit 124 are cleared. By increment correction, the fuel amount is increased to increase the engine speed. When the engine speed exceeds the predetermined speed, the increment correction for the fuel amount is interrupted and control returns to feedback control. At this time, the rich monitoring circuit 124 starts operation. Since when the rich monitoring circuit 124 starts operation, the exhaust gas signal Vs is larger than the reference signal $V_{REF}$, control signal to decrease the fuel amount to make the air-fuel mixture lean will be generated. Therefore, in this operation system, the above-mentioned operations are cyclically issued and thereby the control operation is frequently switched between feedback control and open loop control. This will possibly cause driving the internal combustion engine unstable.

Furthermore, in the above-mentioned operation, the inputs in the rich monitoring circuit 124 are cleared before they reach the given value. Therefore, if the exhaust gas sensor output is varied by engine speed, load condition or the coolant temperature or the exhaust gas sensor is damaged, the rich monitoring circuit can not detect the abnormal condition of the exhaust gas sensor and cannot stop feedback control.

Figure 9:
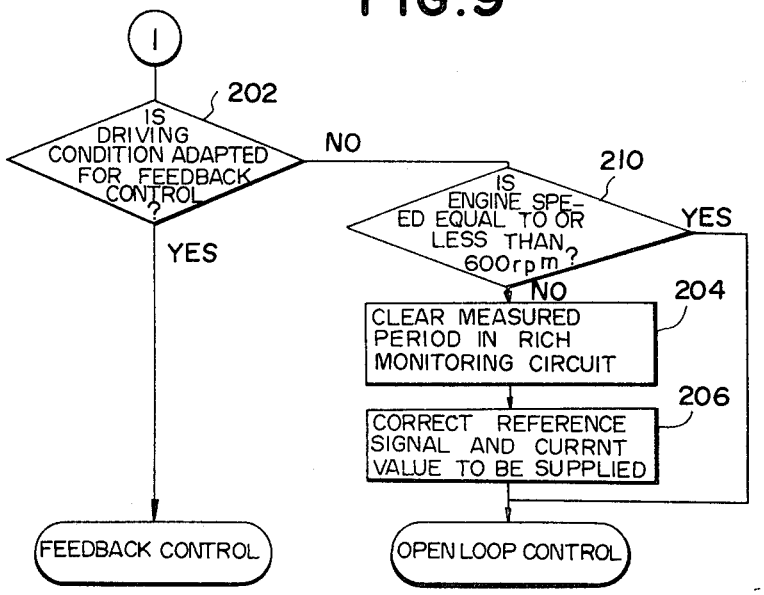
FIG. 9 is a modification of FIG. 8 and is a flowchart of a control operation of the air-fuel ratio control system of FIG. 5.
Figure 10:
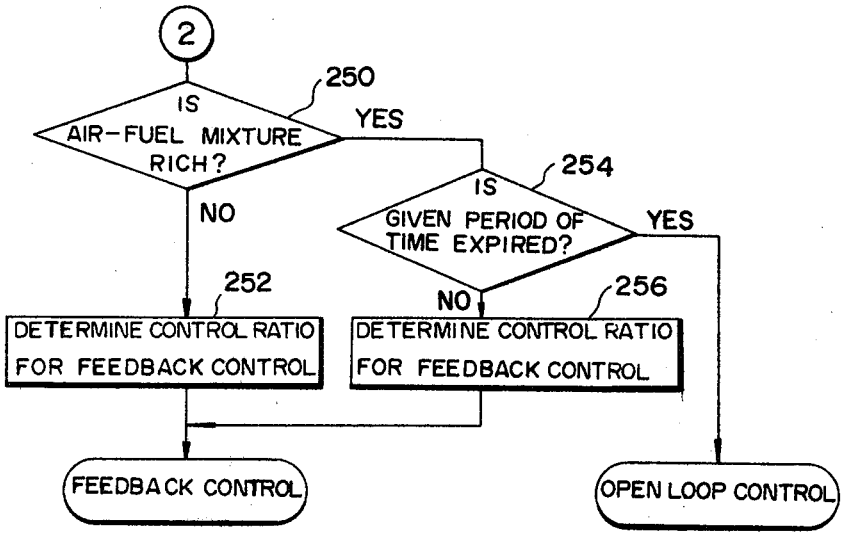
FIG. 10 is another modification of FIG. 8 and is a flowchart of a control operation of the air-fuel ratio control system of FIG. 5.

For improving the above-mentioned drawback in the air/fuel ratio control system, in the modified embodiment of the present invention, inputs of the rich monitoring circuit 124 are not cleared even when the feedback control is interrupted in response to load signal, engine speed signal and lowering of the engine coolant temperature. FIGS. 9 and 10 respectively show flowcharts of modifications of the control operations.

FIG. 9 illustrates the first modification of the control operation, wherein the difference from the embodiment of FIG. 8 is in providing a decision block 210. It should be noted that in this explanation, the operation blocks representing substantially the same operations as those in the foregoing embodiment will be represented by the same reference numerals. If the decision of the block 202 is NO and therefore feedback control is interrupted responsive to the load signal, the engine speed signal and or drop of the engine coolant temperature, the engine speed is checked at the decision block 210 to determine if it is equal to or less than 600 r.p.m. If the decision of the block 210 is NO, the process skips to carry out open loop control and thereby the inputs indicative of a period after a driving condition is detected to carry out open loop control of the rich monitoring circuit 214 is not cleared and the reference signal $V_{REF}$ and current supplied to the exhaust gas sensor are not varied. On the other hand, when the decision of the block 210 is YES, then inputs of the rich monitoring circuit 124 are cleared at the block 204 and the reference signal $V_{REF}$ and current supplied to the exhaust gas sensor 108 are varied at the block 206.

In this way, the rich monitoring circuit can effectively work to selectively carry out feedback control. In this system, when the exhaust gas signal Vs exceeds the reference signal $V_{REF}$, the rich monitoring circuit acts to interrupt feedback control after the expiration of a given time period, e.g. on the order of 6 to 7 sec. Thus, frequent switching between feedback control and open loop control is effectively and successfully eliminated. Moreover, the rich monitoring circuit can also work to detect damaging of the exhaust gas sensor.

Referring to FIG. 10, there is illustrated a system for switching control operation between feedback control and open loop control. A block 250, it is determined whether the air-fuel mixture is rich. If the decision of the block 250 is NO, the control ratio is determined based on the exhaust gas signal for feedback controlling the air/fuel ratio control means 136, at a block 252. When the decision of the block 250 is YES, it is next determined at block 254 whether the given period of time, e.g. about 7 sec., is expired after the air-fuel mixture becomes rich. If the decision of block 254 is NO, the control ratio for feedback controlling the air/fuel ratio control means 136 is determined at a block 256. When the decision of the block 254 is YES, feedback control is interrupted and open loop control is carried out.

In this system, when feedback control is interrupted, the inputs of the rich monitoring circuit 124 can be held. It is also possible to input the signals to the rich monitoring circuit for maintaining sensing operation of detecting a rich signal fed from the discriminator 120. By maintaining the rich monitoring circuit operative and keeping the inputs of the rich monitoring circuit, it is possible to prevent the control operation from temporarily entering into feedback control and thereby to prevent frequent switching of the control operation between feedback control and open loop control.

Although in the present specification, particularly in FIG. 5, illustrates the air/fuel ratio control system as an analog circuit, it is within the scope of this invention to construct such a control system as a digital circuit for use with a microcomputer. It is also within the scope of this invention to use analog or digital circuit element for several functions. For example, the power supply circuit 126, discriminators 128 and 122 and comparator 140 can be combined as a unit of a signal circuit.

Thus, the present invention fullfills all of the object and advantages sought therein.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, the embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An air/fuel ratio control system for an internal combustion engine, comprising:

a sensor for measuring an exhaust gas component concentration and for producing a sensor signal having a value proportional to the measured concentration;

first means for comparing said sensor signal value with a predetermined threshold value in order to discriminate between a rich and lean mixture of air/fuel ratio, said first means producing a rich signal when the sensor signal value is larger than said threshold value and a lean signal when the sensor signal value is smaller than said threshold value;

second means for producing a first feedback disabling signal in response to said rich signal;

means for measuring at least one engine condition other than the air/fuel ratio;

third means responsive to said measuring means for producing a second feedback disabling signal when said at least one other engine condition does not satisfy a predetermined feedback condition; and fourth means responsive to said measuring means for selectively feedback controlling or open loop controlling the air/fuel ratio, said fourth means being responsive to said first and second feedback disabling signals, said fourth means measuring a period of time in which said first feedback disabling signal is inputted and comparing the measured period with a preset value, wherein said fourth means disables said feedback control when the measured period is longer than said preset value and resets the measured period after disabling said feedback control, said fourth means further disabling said feedback control is response to said second feedback disabling signal.

2. A method for switching between feedback control and open loop control in an air/fuel ratio control system for an internal combustion engine, in which the air/fuel ratio of an air-fuel mixture is selectively controlled in either a feedback or open loop mode based upon predetermined criteria and upon an exhaust gas component concentration, the method comprising:

generating a reference signal and varying said reference signal in response to a first sensor signal from an exhaust gas sensor;

comparing said first sensor signal and said reference signal to determine a rich or lean condition of said air-fuel mixture;

measuring a time period starting from the time when said air-fuel mixture becomes rich;

interrupting feedback control with said air-fuel mixture is rich for a predetermined time and clearing said measured period;

interrupting feedback control when an engine coolant temperature is lower than a given temperature, or an engine load condition is not adapted to carry out feedback control or an engine speed is less than a given speed;

carrying out open loop control in response to interrupting said feedback control.

3. An air/fuel ratio control system for performing feedback control of the air/fuel ratio of an air/fuel mixture based upon the concentration of an exhaust gas component of an internal combustion engine when a predetermined feedback condition is satisfied, and for performing open loop control of the air/fuel ratio based upon open loop parameters when the feedback condition is not satisfied, said system comprising:

a first sensor for measuring the concentration of an exhaust gas component and producing a first sensor signal having a value proportional to the measured concentration;

a second sensor for measuring engine speed and producing a second sensor signal having a value proportional to measured engine speed;

a first means for producing a reference signal representative of a reference value which is determined based on said first sensor signal value;

a second means for comparing said first sensor signal value with said reference signal value to discriminate between a rich and a lean air/fuel mixture and for producing a rich signal when the first sensor signal value is larger than said reference signal value and a lean signal when the first signal value is smaller than the reference signal value;

a third means for measuring a period of time during which said second means continuously outputs said rich signal, said third means producing a first feedback disabling signal when the measured time period exceeds a predetermined value;

a fourth means for producing a second feedback disabling signal when said feedback condition is not satisfied with respect to parameters defining said feedback condition other than rich/lean of the air/fuel mixture; and a fifth means for effecting feedback control and open loop control selectively, said fifth means being responsive to said first and second feedback disabling signals to switch the control mode from feedback control to open loop control and for resetting said third means to clear the measured time period in response to said first feedback disabling signal.

4. An air/fuel ratio control system as set forth in claim 3, further comprising a sixth means for comparing said second sensor signal value with a given value, said sixth means operable for resetting said third means to clear the measured time period when the control mode is switched from feedback control to open loop and when said second sensor signal value is larger than said given value.

5. An air/fuel ratio control system as set forth in claim 3 or 4, wherein said third means holds the measured value while feedback control is disabled.

6. An air/fuel ratio control system as set forth in claim 3 or 4, wherein said third means continues measuring during the period of time when the air/fuel mixture is rich while feedback control is disabled.

7. A control system as set forth in claim 1, wherein said system further comprises a fifth means for supplying electric current to said sensor, wherein said fifth means varies said current value depending upon the temperature condition of said sensor.

8. A control system as set forth in claim 1 or 7, wherein said first means varies said threshold value corresponding to said sensor output voltage.

9. A control system as set forth in claim 8, wherein said reference value is initially set at a minimum value and maintained for a first given time period, and whereupon after expiration of said time period, said reference value is increased at a given rate and given timing until is reaches a given maximum value, and thereafter is decreased at a given rate and a given timing until the given minimum value.

10. A control system as set forth in claim 9, wherein said reference value is maintained at the minimum value during normal control operation and is increased at a given value during feedback control.

11. A control system as set forth in claim 1, wherein said third means is operative responsive to engine speed, load condition of the internal combustion engine and the engine coolant temperature.

12. A control system as set forth in claim 1, wherein said fourth means is not cleared of said measured period when the engine speed is less than a given speed.

13. A control system as set forth in claim 12, wherein when said measured period is not cleared and feedback control is interrupted, said measured period is held at a fixed value.

14. A control system as set forth in claim 12, wherein when said measured period is not cleared and feedback control is interrupted, said fourth means continues the period until it reaches said given period.

15. A method as set forth in claim 2, wherein said method further comprising the step of supplying an electric current to said exhaust gas sensor and measuring an output from said sensor to determine if said sensor is in condition for carrying out feedback control.

16. A method as set forth in claim 2 or 15, wherein said step for supplying electric current to said exhaust gas sensor further includes varying the value of current supplied thereto corresponding to an operating condition of said air/fuel ratio control system.

17. A method as set forth in claim 2, wherein said reference signal is initially set at a minimum value and maintained for a given period and is increased at a given rate and a given timing after expiration of said given period and decreased a second given rate and a second given timing after reaching said reference signal at a given maximum value.

18. A method as set forth in claim 8, wherein said reference signal is maintained after decreasing to said minimum value when open loop control is carried out and is increased by a given third rate in response to switching the control operation from open loop control to feedback control, said increased reference signal being returned to said minimum value in response to switching the control operation from feedback control to open loop control.

* * * * *